US011151957B2

(12) United States Patent
Shimizu et al.

(10) Patent No.: US 11,151,957 B2
(45) Date of Patent: Oct. 19, 2021

(54) DISPLAY DEVICE, DRIVE VOLTAGE SETTING METHOD, AND COMPUTER PROGRAM

(71) Applicant: SAKAI DISPLAY PRODUCTS CORPORATION, Sakai (JP)

(72) Inventors: Yoshiyuki Shimizu, Sakai (JP); Shuji Uemura, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 73 days.

(21) Appl. No.: 16/608,653

(22) PCT Filed: Apr. 27, 2017

(86) PCT No.: PCT/JP2017/016842
§ 371 (c)(1),
(2) Date: Oct. 25, 2019

(87) PCT Pub. No.: WO2018/198291
PCT Pub. Date: Nov. 1, 2018

(65) Prior Publication Data
US 2021/0118398 A1 Apr. 22, 2021

(51) Int. Cl.
*G09G 3/36* (2006.01)

(52) U.S. Cl.
CPC ..... *G09G 3/3696* (2013.01); *G09G 3/3677* (2013.01)

(58) Field of Classification Search
CPC ..... G09G 3/3696; G09G 3/3677; G09G 2330/028
See application file for complete search history.

(56) References Cited

U.S. PATENT DOCUMENTS 6,639,634 B1 10/2003 Zhang et al.
2013/0328749 A1* 12/2013 Jamal ..... G09G 3/3648 345/55
2016/0180771 A1* 6/2016 Jeong ..... G09G 3/2003 345/211
2018/0308448 A1* 10/2018 Lee ..... G09G 3/3696

FOREIGN PATENT DOCUMENTS

JP 2000-275669 A 10/2000

* cited by examiner

*Primary Examiner* — Stephen G Sherman
(74) *Attorney, Agent, or Firm* — ScienBiziP, P.C.

(57) ABSTRACT

This display device is provided with: a gate driver that drives a display panel; and a control circuit that controls driving of the gate driver. The control circuit is provided with: a Voltage supply circuit that supplies a Voltage to the gate driver; and a current detection circuit that detects a current to be supplied to the gate driver. The display device reduces, in stages, the voltage to be supplied to the gate driver, and detects the current to be supplied to the gate driver, and in the cases where the detected current is equal to or lower than a predetermined value or a current increase is detected, the display device acquires a first voltage being supplied to the gate driver, and sets a second voltage as a drive voltage for driving the gate driver, said second voltage being obtained by adding a predetermined voltage to the acquired first voltage.

10 Claims, 6 Drawing Sheets

DISPLAY DEVICE, DRIVE VOLTAGE SETTING METHOD, AND COMPUTER PROGRAM

TECHNICAL FIELD

The present invention relates to a display apparatus, a method for setting the drive voltage, and a computer program by which a drive voltage of a gate driver for deriving a display panel is set.

BACKGROUND ART

Currently, active-matrix liquid-crystal displays are widely used as display devices. A liquid-crystal display apparatus includes a liquid-crystal panel in which liquid crystal is sandwiched between a cell array substrate and a counter substrate, and a display region of the cell array substrate is provided with a plurality of pixels arranged in a matrix. Each pixel includes a thin film transistor, a pixel electrode connected to the thin film transistor to drive liquid crystal, and the like. On a margin of the display region of the cell array substrate, a gate driver for supplying a gate signal to the pixels and a source driver for supplying display data corresponding to image signals are provided.

Recently, as with the thin film transistor of each pixel, a thin film transistor is used also in the gate driver to be built in a cell array substrate as a so-called gate driver on array (GOA), in which the gate driver is built in the cell array substrate, is formed. The thin film transistor constituting the gate driver is directly mounted on the cell array substrate.

In a case of GOA, manufacturing cost of the liquid crystal display apparatus can be reduced as compared to a case where an IC chip is used in the gate driver and mounted on a substrate by tape automated bonding (TAB), chip on glass (COG), or the like (see, for example, Patent Literature 1).

CITATION LIST

Patent Literature

[Patent Literature 1]: Japanese Patent Application Laid-Open Publication No. 2000-275669

SUMMARY OF INVENTION

Technical Problem

Thin film transistors are deteriorated by voltage application, and the higher the applied voltage is, to the higher degree the thin film transistors deteriorate. Therefore, the drive voltage of a gate driver including a thin film transistor is desirably set to a value as low as possible. By contrast, when the voltage applied to the thin film transistors is too low, the gate driver may stop due to, for example, influence of ambient temperature or the deterioration of the thin film transistor.

The present invention was made in view of such circumstances, and an object of the present invention is to provide a display apparatus, a drive voltage setting method, and a computer program which can set an optimal drive voltage for a gate driver including a thin film transistor.

Solution to Problem

A display apparatus according to the present invention is a display apparatus comprising: a gate driver that drives a display panel; and a control circuit that controls driving of the gate driver, wherein the control circuit includes a voltage supply circuit that supplies voltage to the gate driver; and a current detection circuit that detects a current to be supplied to the gate driver; the control circuit detects the current to be supplied to the gate driver while the voltage supplied to the gate driver is reduced in stages, when the current detected is equal to or lower than a predetermined value or when an increase in the current is detected, the control circuit acquires a first voltage supplied to the gate driver, and the control circuit sets a second voltage as a drive voltage for driving the gate driver, the second voltage being obtained by adding a predetermined voltage to the acquired first voltage.

A drive voltage setting method according to the present invention is a drive voltage setting method for setting a drive voltage of a gate driver that drives a display panel, the method comprising: detecting a current supplied to the gate driver while reducing the voltage supplied to the gate driver in stages, acquiring a first voltage supplied to the gate driver when the current detected is equal to or lower than a predetermined value or when an increase in the current is detected, and setting a second voltage as a drive voltage for driving the gate driver, the second voltage being obtained by adding a predetermined voltage to the acquired first voltage.

A computer program according to the present invention is a computer program that can be executed by a control device that controls driving of a gate driver for driving a display panel, wherein the program allows the control device to, while reducing a voltage supplied to the gate driver in stages, detect a current supplied to the gate driver, and when the current detected is equal to or lower than a predetermined value or when an increase in the current is detected, acquire a first voltage supplied to the gate driver, and set a second voltage as a drive voltage for driving the gate driver, the second voltage being obtained by adding a predetermined voltage to the acquired first voltage.

Advantageous Effects of Invention

According to the present invention, an optimal drive voltage for a gate driver including a thin film transistor can be set.

DESCRIPTION OF EMBODIMENTS

First Embodiment

Figure 1:
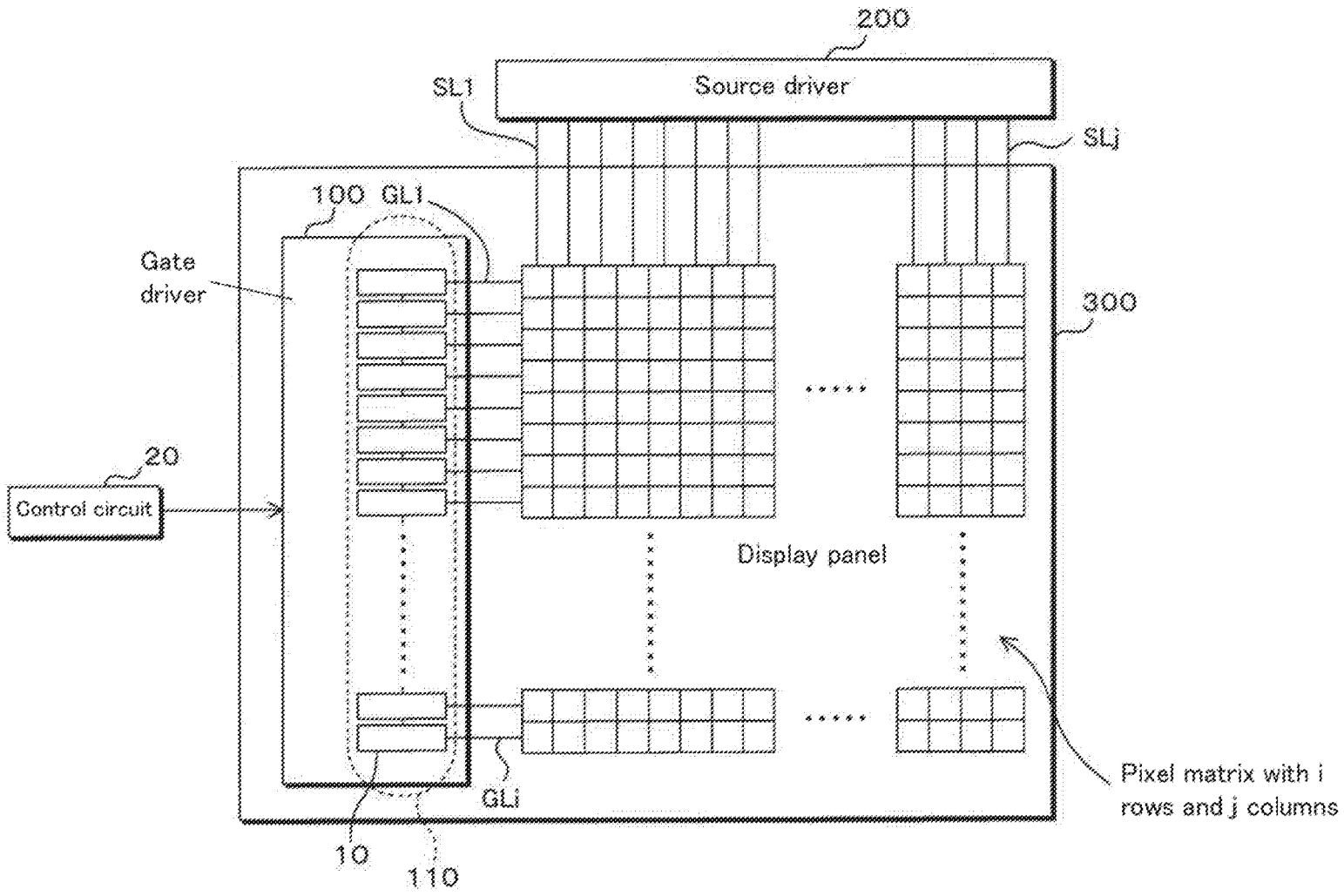
FIG. 1 is a schematic diagram illustrating a display apparatus according to a first embodiment.

The following describes a display apparatus according to a first embodiment of the present invention based on diagrams. FIG. 1 is a schematic diagram illustrating a display apparatus. The display apparatus is, for example, an active matrix liquid crystal display apparatus. As shown in FIG. 1, the display apparatus includes a gate driver 100, a source driver 200, a display panel 300, and the like. Note that the gate driver 100 is formed on the display panel 300 using, for example, amorphous silicon, polycrystalline silicon, microcrystalline silicon, or an oxide semiconductor. More specifically, the gate driver 100 is formed on a light-transmitting pixel substrate (also called an active matrix substrate or a cell array substrate) and includes a thin film transistor.

Between the display panel 300 and the source driver 200, a plurality of (j in the example of FIG. 1) source bus lines SL1 to SLj are connected. Also, between the display panel 300 and the gate driver 100, a plurality of (i in the example of FIG. 1) gate bus lines GL1 to GLi are connected. At each of intersections of the plurality of source bus lines and the plurality of gate bus lines, a pixel formation portion is provided. The pixel formation portions are arranged in a matrix and each include a thin film transistor, a pixel capacitor for holding a pixel voltage value, and the like.

Based on input signals such as a digital video signal, a source start pulse signal, and a source clock signal, the source driver 200 outputs driving video signals to the respective source bus lines SL1 to SLj. The gate driver 100 includes a shift register group 110 in which a plurality of shift registers 10 are connected to each other.

Based on a gate start pulse signal, a gate end pulse signal, and a clock signal output from a control circuit 20 (a control device), the gate driver 100 sequentially outputs drive signals to the respective gate bus lines GL1 to GLi. Note that the drive signals are repeatedly output to the respective gate bus lines GL1 to GLi every one vertical scanning period.

Figure 2:
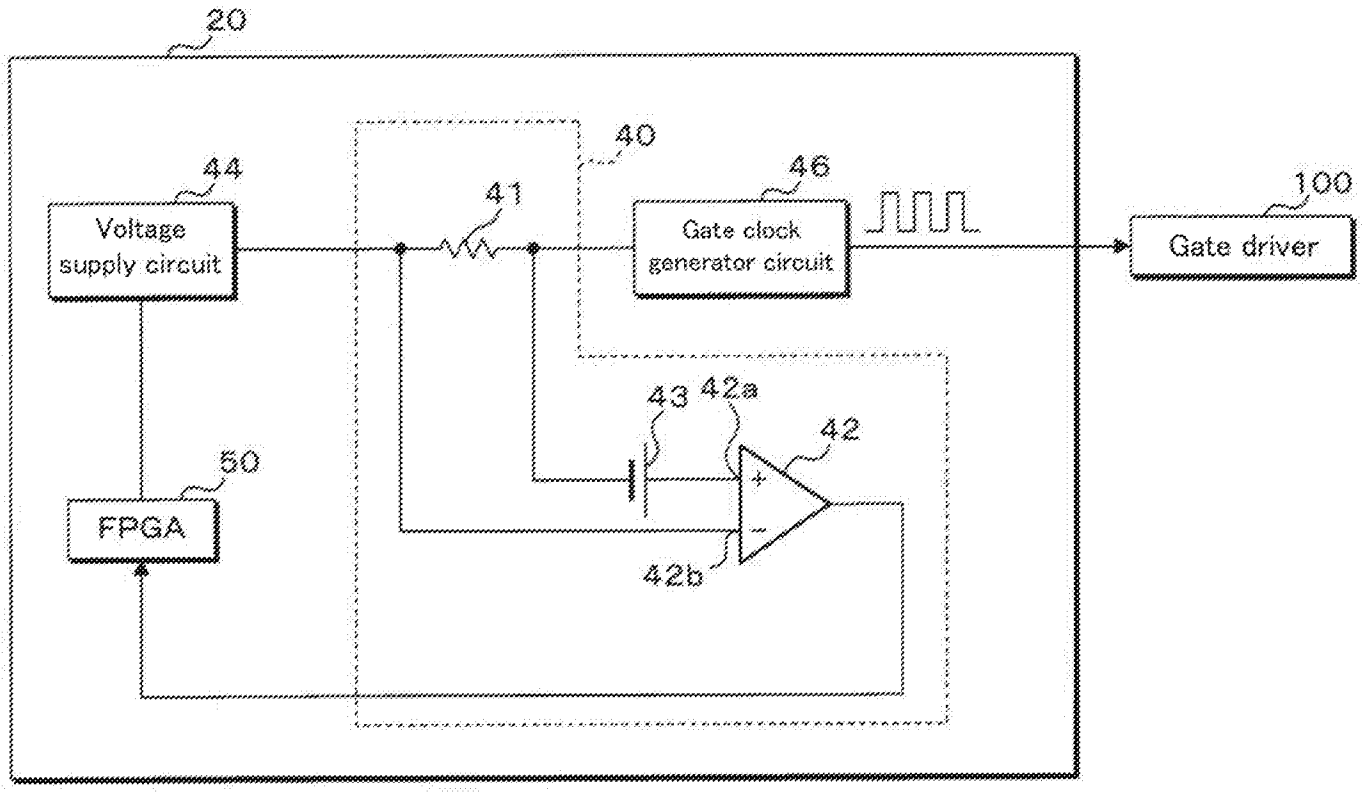
FIG. 2 is a block diagram schematically showing a control circuit.

FIG. 2 is a block diagram schematically illustrating the control circuit 20. As illustrated in FIG. 2, the control circuit 20 includes a voltage supply circuit 44 that supplies a voltage to the gate driver 100, a current detection circuit 40, a field programmable gate array (FPGA) 50 that controls driving of the voltage supply circuit 44, and a gate clock generator circuit 46 that generates a clock signal to be input to the gate driver 100. The FPGA 50 reads a control program stored in a memory (not illustrated), and sets a drive voltage of the gate driver 100 based on the control program.

The FPGA 50 is an example of a circuit that controls driving of the voltage supply circuit 44. The control circuit for controlling driving of the voltage supply circuit 44 is not limited thereto, and may be, for example, an application specific integrated circuit (ASIC) or a central processing unit (CPU). The control program may be stored in a medium such as a CD-ROM so that the FPGA or a CPU can access the medium.

The voltage supply circuit 44 changes the voltage to be supplied to the gate driver 100 based on a command from the FPGA 50. The voltage supply circuit 44 outputs a DC voltage.

The current detection circuit 40 includes a detection resistor 41, an operational amplifier 42, and a power supply 43. The detection resistor 41 is connected in series between the voltage supply circuit 44 and the gate driver 100. A positive phase input terminal 42*a* of the operational amplifier 42 is connected to one end of the detection resistor 41 via the power supply 43. The power supply 43 applies a predetermined voltage to the positive phase input terminal 42*a*. The negative phase input terminal 42*b* of the operational amplifier 42 is connected to the other end of the detection resistor 41. The output of the operational amplifier 42 is input to the FPGA 50. The gate clock generator circuit 46 is connected in series between one end of the detection resistor 41 and the gate driver 100.

The voltage supply circuit 44 inputs a DC voltage via the detection resistor 41 to the gate clock generator circuit 46, and the gate clock generator circuit 46 generates a clock signal and supplies the generated clock signal to the gate driver 100. A difference between a high level potential and a low level potential of the clock signal is the voltage supplied to the gate driver 100.

Figure 3:
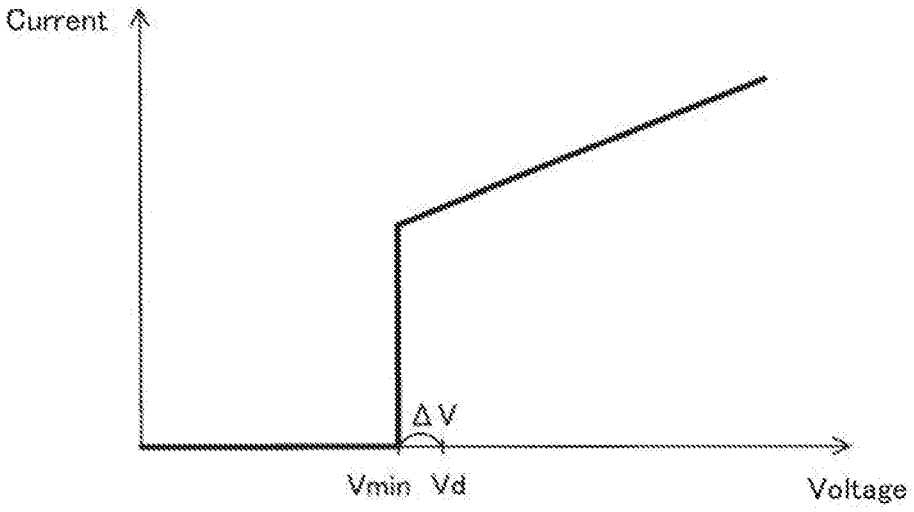
FIG. 3 is a graph showing a relationship between gate driver voltage and gate driver current in the first embodiment.

FIG. 3 is a graph showing a relationship between voltage applied to the gate driver 100 (hereinafter also referred to as gate driver voltage) and current flowing through the gate driver 100 (hereinafter also referred to as gate driver current) in the first embodiment. In FIG. 3, the horizontal axis indicates magnitude of the gate driver voltage, and the vertical axis indicates magnitude of the gate driver current. When the display apparatus is activated, the FPGA 50 outputs, to the voltage supply circuit 44, a command to supply a voltage of which level is maximum first and then is decreased in stages. That is, the voltage supply circuit 44 first supplies a maximum voltage to the gate driver 100, and then the gate driver voltage is decreased in stages. As shown in FIG. 3, with the gradual decrease in the gate driver voltage, the gate driver current also decreases in stages.

When the gate driver voltage is higher than a minimum voltage (hereinafter referred to as voltage Vmin) (first voltage) capable of driving the gate driver 100, the gate driver 100 is driven and consumes current. The potential input to the negative phase input terminal 42*b* of the operational amplifier 42 is higher than the potential input to the positive phase input terminal 42*a*, and the operational amplifier 42 outputs a low signal, which is then input to the FPGA 50.

When the gate driver voltage is equal to or lower than the voltage Vmin, the gate driver 100 stops its driving and comes to consume little current. In this time, the potential difference between both ends of the detection resistor 41 disappears, and as shown in FIG. 3, the gate driver current rapidly decreases and becomes equal to or lower than the predetermined value. Then, as a result of voltage application by the power supply 43, the potential input to the positive phase input terminal 42*a* becomes higher than the potential input to the negative phase input terminal 42*b* of the operational amplifier 42. Accordingly, the operational amplifier 42 outputs a high signal, which is then input to the FPGA 50. The FPGA 50 detects, based on the switching of the signal input by the current detection circuit 40 from a high signal to a low signal, that the gate driver current rapidly decreased and the gate driver voltage became equal to or lower than the voltage Vmin.

The FPGA 50 acquires the gate driver voltage at the time when the signal input by the current detection circuit 40 is switched from a low signal to a high signal (voltage Vmin), and sets a value obtained by adding a predetermined voltage $\Delta V$ to the voltage Vmin as a voltage to be actually applied to the gate driver 100 for driving the gate driver 100 (hereinafter referred to as drive voltage Vd) (second voltage). Note that, at the time of switching from the low signal to the high signal, the FPGA 50 ends the process of reducing the gate driver voltage in stages. The FPGA 50 executes the process for setting the drive voltage Vd of the gate driver 100 every time the display apparatus is driven.

In the display apparatus and the driving voltage setting method according to the first embodiment, the control circuit 20 detects the gate driver current while decreasing the gate driver voltage in stages. Based on the detected gate driver current, the control circuit 20 acquires a gate driver voltage (voltage Vmin) immediately before the gate driver 100 becomes unable to be driven.

The control circuit 20 sets a voltage Vd, which is obtained by adding the predetermined voltage ΔV to the voltage Vmin, as the drive voltage Vd of the gate driver 100. Thus, since a value obtained by adding the predetermined voltage ΔV to the voltage Vmin is used as the drive voltage Vd of the gate driver 100, the drive voltage Vd is a highly reliable voltage that allows the gate driver 100 to drive normally. Furthermore, the drive voltage Vd, which is based on the lowest voltage (voltage Vmin) capable of normally driving the gate driver 100, is prevented from becoming higher than necessary.

Second Embodiment

Figure 4:
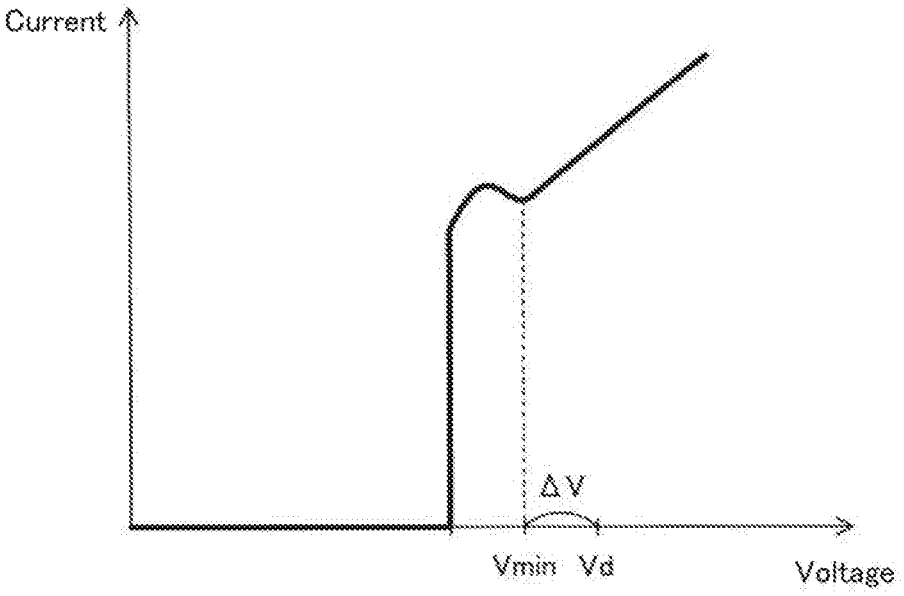
FIG. 4 is a graph showing a relationship between gate driver voltage and gate driver current in a second embodiment.

The following describes a second embodiment of the present invention based on diagrams. Of the elements of configuration according to the second embodiment, elements of configuration similar to those according to the first embodiment are assigned the same reference signs, and detailed descriptions thereof are omitted. FIG. 4 is a graph showing a relationship between gate driver voltage and gate driver current in the second embodiment. In FIG. 4, the horizontal axis indicates magnitude of the gate driver voltage, and the vertical axis indicates magnitude of the gate driver current.

When the display apparatus is activated, the FPGA 50 outputs, to the voltage supply circuit 44, a command to supply a voltage of which level is maximum first and then is decreased in stages. That is, the voltage supply circuit 44 first supplies a maximum voltage to the gate driver 100, and then the gate driver voltage is decreased in stages. As shown in FIG. 4, with the gradual decrease in the gate driver voltage, the gate driver current also decreases in stages.

Usually, while the gate driver voltage is decreased, the gate driver current also decreases. As the gate driver current decreases, the gate driver 100 becomes more susceptible to noise. Therefore, due to the influence of noise, the gate driver current can increase even when the gate driver voltage is decreased. There is a possibility that the gate driver 100 does not operate normally due to the influence of noise in a situation in which an increase in the gate driver current is detected.

As shown in FIG. 4, when the gate driver current increases despite the decrease in the gate driver voltage, the magnitude of the output value of the operational amplifier 42 increases. The FPGA 50 can detect an increase in the gate driver current based on a change in the magnitude of the output value of the operational amplifier 42.

The FPGA 50 acquires a gate driver voltage at the time when the gate driver current increases (in this embodiment, this voltage corresponds to voltage Vmin (first voltage)), and sets a value obtained by adding the predetermined voltage ΔV to the voltage Vmin as a drive voltage Vd of the gate driver 100 (second voltage). Note that, at the time when the current increases, the FPGA 50 ends the process of reducing the gate driver voltage in stages. The FPGA 50 executes the process for setting the drive voltage Vd of the gate driver 100 every time the display apparatus is driven.

According to the second embodiment, the control circuit 20 acquires a gate driver voltage (voltage Vmin) at the time when an increase in the gate driver current is detected.

Third Embodiment

Figure 5:
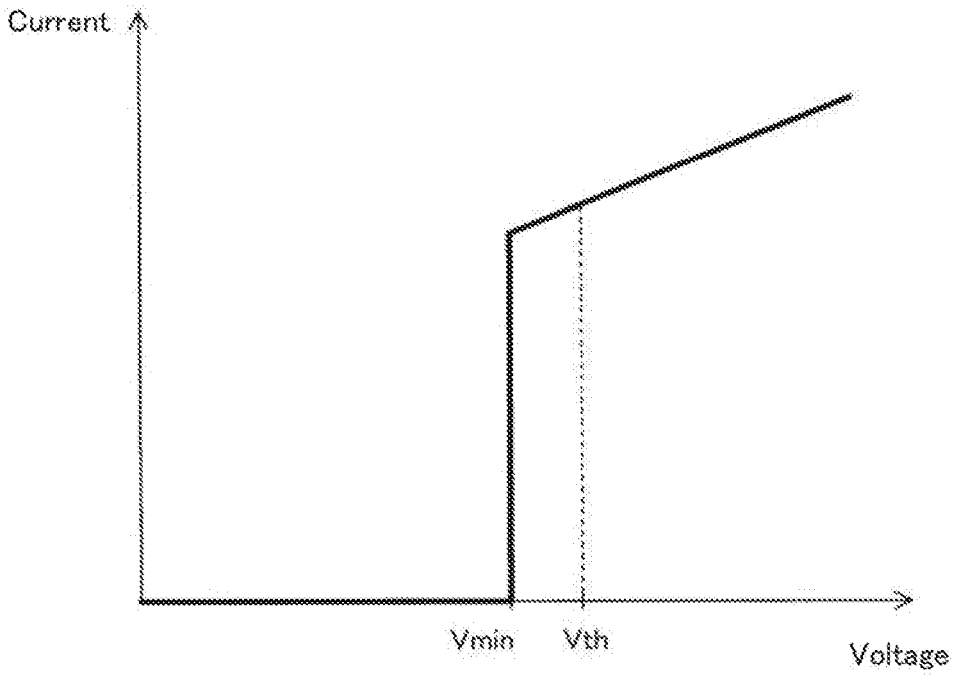
FIG. 5 is a graph showing a relationship between gate driver voltage and gate driver current in a third embodiment.

The following describes a third embodiment of the present invention based on diagrams, Of the elements of configuration according to the third embodiment, elements of configuration similar to those according to the first or second embodiment are assigned the same reference signs, and detailed descriptions thereof are omitted. FIG. 5 is a graph showing a relationship between gate driver voltage and gate driver current in the third embodiment. In FIG. 5, the horizontal axis indicates the magnitude of the gate driver voltage, and the vertical axis indicates the magnitude of the gate driver current. In the third embodiment, a threshold Vth of a voltage (third voltage) for normally driving the gate driver 100 is preset.

When the display apparatus is activated, the FPGA 50 outputs, to the voltage supply circuit 44, a command to supply a voltage of which level is maximum first and then is decreased in stages. That is, the voltage supply circuit 44 first supplies a maximum voltage to the gate driver 100, and then the gate driver voltage is decreased in stages.

In a situation in which the gate driver voltage reaches the threshold Vth before a rapid decrease in the gate driver current is detected, that is, before the gate driver voltage reaches the voltage Vmin, the FPGA 50 sets the threshold Vth to the drive voltage Vd of the gate driver 100. Since the drive voltage of the gate driver 100 is equal to or higher than the preset threshold Vth, it is possible to prevent malfunction of the gate driver 100 and maintain image quality.

The same applies to a situation in which an increase in the gate driver current is detected, the relationship in which is not shown though in FIG. 5. That is, when the gate driver voltage reaches the threshold Vth before an increase in the gate driver current is detected (before the gate driver voltage reaches the voltage Vmin), the FPGA 50 sets the threshold Vth to the drive voltage Vd of the gate driver 100.

Fourth Embodiment

Figure 6:
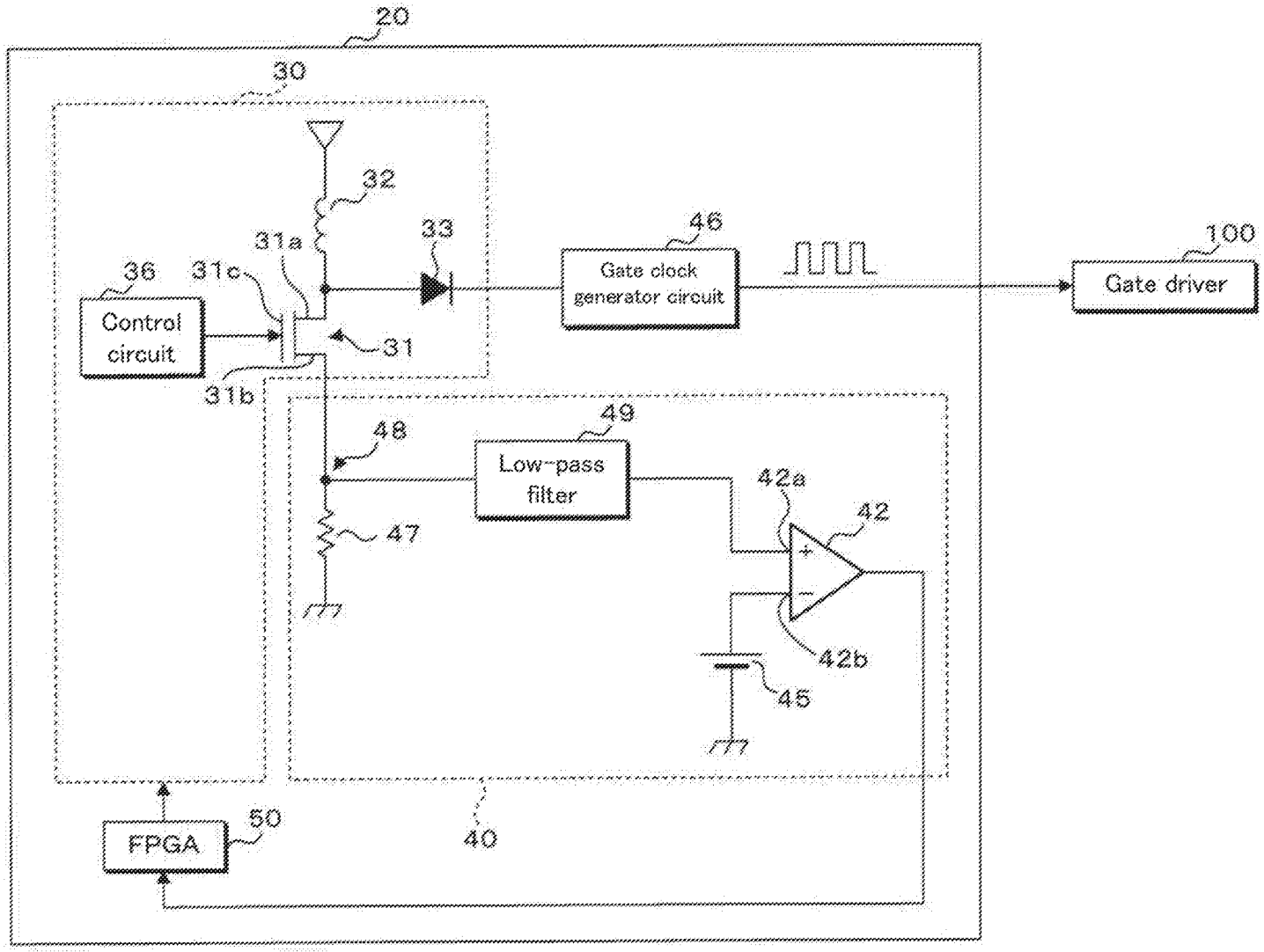
FIG. 6 is a block diagram schematically illustrating a control circuit of a display apparatus according to a fourth embodiment.

The following describes a fourth embodiment of the present invention based on diagrams. FIG. 6 is a block diagram schematically illustrating a control circuit 20 of a display apparatus according to a fourth embodiment. A voltage supply circuit 30 includes a field-effect transistor (FET) 31 having a source 31*b* connected to the ground, a coil 32 having one end connected to a drain 31*a* of the FET 31, a diode 33 having an anode connected to one end of the coil 32 and the source 31*b*, and a control circuit 36 that outputs a control signal to a gate 31*c* of the FET 31. To the other end of the coil 32, a predetermined DC voltage is applied. The diode 33 has a cathode connected to a gate driver 100 via a gate clock generator circuit 46. A FPGA 50 inputs a control signal to the voltage supply circuit 30.

A current detection circuit 40 includes a low-pass filter 49, an operational amplifier 42, and a detection resistor 47 connected between the source 31*b* and the ground. The source 31*b* of the FET 31 is connected to the positive phase input terminal 42*a* of the operational amplifier 42 via the tow-pass filter 49. In the following description, the vicinity of a connection between the source 31*b* and the low-pass filter 49 is referred to as a node 48. To the negative phase input terminal 42*b* of the operational amplifier 42, a power supply 45 is connected. The power supply 45 applies a reference voltage Vs to the negative phase input terminal 42*b*. The output of the operational amplifier 42 is input to the FPGA 50.

Figure 7:
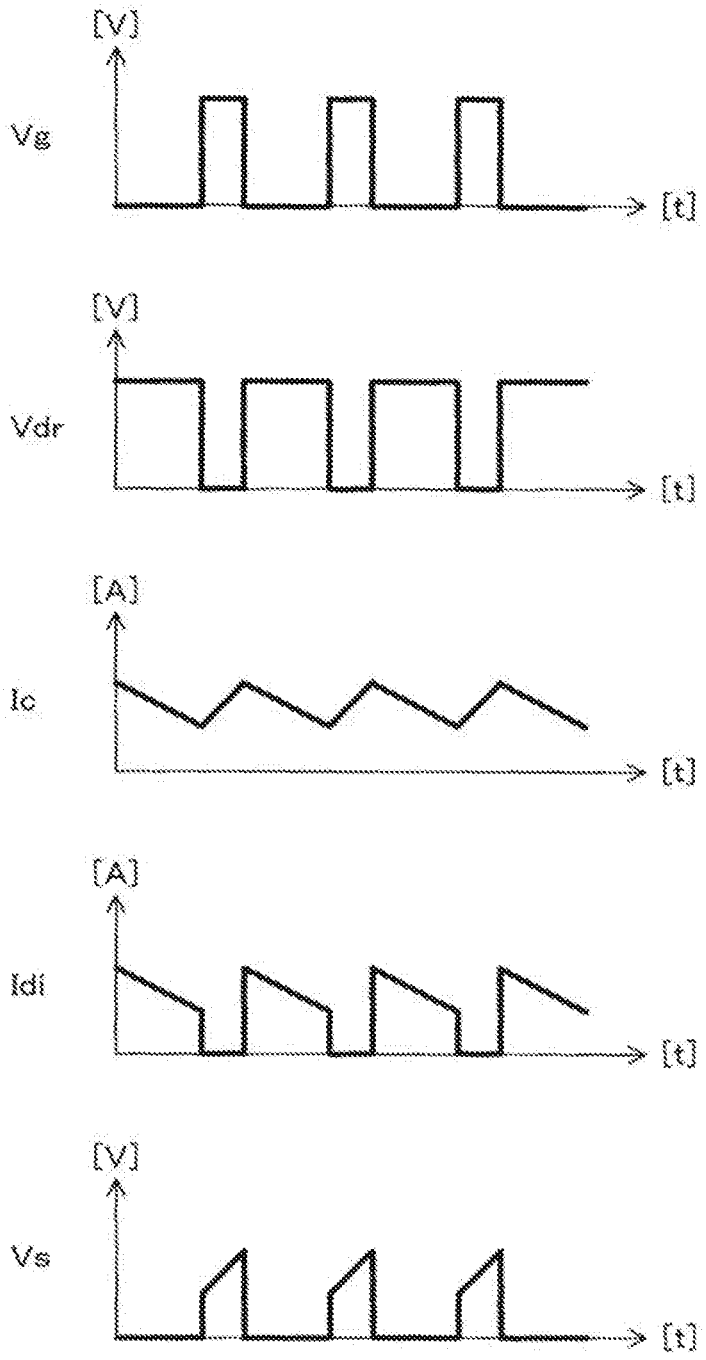
FIG. 7 is a timing chart showing gate voltage, drain voltage, coil current, diode current, and resistance voltage.

Here, let the voltage of the gate 31*c* be a gate voltage Vg, the voltage of the drain 31*a* be a drain voltage Vdr, the current of the coil 32 be a coil current Ic, the current of the diode 33 be a diode current Idi, and the voltage of the detection resistor 47 be a resistance voltage Vs. FIG. 7 is a timing chart of the gate voltage Vg, the drain voltage Vdr, the coil current Ic, the diode current Idi, and the resistance voltage Vs. In FIG. 7, [V] indicates voltage value, [A] indicates current value, and [t] indicates time.

As shown in FIG. 7, when the FET 31 is turned on, that is, when the gate voltage Vg becomes high, the drain voltage Vdr drops. As a result, a voltage is applied from the DC voltage to the coil in the direction of FET 31, and the coil current Ic increases. During this period, the diode current Idi does not flow, the coil current Ic flows through the FET 31 and the detection resistor 47 in this order, and the resistance voltage Vs, that is, the potential of the node 48 increases with the increase in the coil current Ic. When the FET 31 is turned off, that is, when the gate voltage Vg becomes low, the coil current Ic flows through the diode 33 and becomes an output current of the voltage supply circuit 30. In this time, since no current flows through the detection resistor 47, the resistance voltage Vs, that is, the potential of the node 48 is the ground potential.

When the output current of the voltage supply circuit 30 decreases (that is, when the gate driver current decreases), the coil current Ic decreases, so that the voltage generated when the coil current Ic flows through the detection resistor 47 also decreases, and also an average value of the voltage of the node 48 input through the low-pass filter 49 to the positive phase input terminal 42*a* of the operational amplifier 42 decreases. When the average value of the voltage of the node 48 becomes lower than the reference voltage Vs input to the negative phase input terminal 42*b* of the operational amplifier 42, the operational amplifier 42 outputs a low signal, which is then input to the FPGA 50.

When the display apparatus is activated, the FPGA 50 outputs, to the voltage supply circuit 44, a command to supply a voltage of which level is maximum first and then decreases in stages. Specifically, the FPGA 50 reduces, in stages, the duty cycle of the control signal for the FET 31 output from the control circuit 36. Since the supply voltage of the voltage supply circuit 30 decreases in proportion to the duty cycle of the clock signal input to the gate 31*c*, and the supply current also concomitantly decreases, the average value of the voltage input through the low-pass filter 49 to the positive phase input terminal 42*a* of the operational amplifier 42 decreases.

When the gate driver voltage becomes equal to or lower than the voltage Vmin, the gate driver 100 stops driving and comes to consume no current. At this time, the voltage input to the positive phase input terminal 42*a* of the operational amplifier 42 is lower than the reference voltage Vs input to the negative phase input terminal 42*b* of the operational amplifier 42, and the operational amplifier 42 outputs a low signal, which is then input to the FPGA 50. The FPGA 50 can detect, based on the switching of the signal input by the current detection circuit 40 from a High signal to a low signal, that the gate driver current rapidly decreased and the gate driver voltage became equal to or lower than the voltage Vmin.

The FPGA 50 acquires a gate driver voltage at the time of the switching from a high signal to a low signal (in the present embodiment, this voltage corresponds to the voltage Vmin), and sets a value obtained by adding the predetermined voltage ΔV to the voltage Vmin as the drive voltage Vd of the gate driver 100.

The FPGA 50 may detect an increase or decrease in the gate driver current based on a change in the magnitude of the output value of the operational amplifier 42, acquire a gate driver voltage at the time of an increase in the gate driver current (voltage Vmin), and set a value obtained by adding the predetermined voltage ΔV to the voltage Vmin as the drive voltage Vd of the gate driver 100.

Embodiments disclosed here are exemplary in all respects, and should not be considered to be limitative. The technical features described in each example can be combined with each other, and the scope of the present invention is intended to include all alterations within the scope of the claims and any scope equivalent to the scope of the present claims.

REFERENCE SIGNS LIST

20 Control circuit
30, 44 Voltage supply circuit
40 Current detection circuit
41 Detection resistor
42 Operational amplifier
49 Low-pass filter
100 Gate driver
300 Display panel

The invention claimed is:

1. A display apparatus comprising:
a gate driver configured to drive a display panel; and
a control circuit configured to control driving of the gate driver, wherein
the control circuit includes:
a voltage supply circuit that supplies a voltage to the gate driver; and
a current detection circuit that detects a current to be supplied to the gate driver,
the control circuit detects the current to be supplied to the gate driver while supplying the voltage to the gate driver, the voltage being reduced in stages,
at a time when the current detected is equal to or lower than a predetermined value or when an increase in the current is detected, the control circuit acquires a first voltage supplied to the gate driver at the time, and
the control circuit determines the acquired first voltage as a voltage immediately before the gate driver becomes unable to be driven.

2. The display apparatus according to claim 1, wherein
when the voltage supplied to the gate driver becomes equal to or lower than a predetermined second voltage before the current detected becomes equal to or lower than the predetermined value or before an increase in the current is detected, the control circuit sets the second voltage as a drive voltage for driving the gate driver.

3. The display apparatus according to claim 1, wherein
the control circuit acquires the first voltage at each activation thereof.

4. The display apparatus according to claim 1, wherein the current detection circuit includes:
a detection resistor provided in series between the voltage supply circuit and the gate driver; and
an operational amplifier including a positive phase input terminal connected to one end of the detection resistor and a negative phase input terminal connected to the other end of the detection resistor.

5. The display apparatus according to claim 1, wherein the current detection circuit includes:
a low-pass filter to which the voltage supplied from the voltage supply circuit to the gate driver is input; and
an operational amplifier connected to the low-pass filter.

6. The display apparatus according to claim 1, wherein the control circuit sets a voltage greater than the acquired first voltage as a drive voltage for driving the gate driver.

7. A drive voltage setting method for setting a drive voltage of a gate driver that drives a display panel, the method comprising:

detecting a current supplied to the gate driver while reducing the voltage supplied to the gate driver in stages;

acquiring, at a time when the current detected is equal to or lower than a predetermined value or when an increase in the current is detected, a first voltage supplied to the gate driver at the time; and determining the acquired first voltage as a voltage immediately before the gate driver becomes unable to be driven.

8. The drive voltage setting method according to claim 7, further comprising setting a voltage greater than the acquired first voltage as a drive voltage for driving the gate driver.

9. A non-transitory computer-readable storage medium storing a computer program capable of being executed by a control device that controls driving of a gate driver for driving a display panel, wherein the computer program causes the control device to detect a current supplied to the gate driver while reducing the voltage supplied to the gate driver in stages, acquire, at a time when the current detected is equal to or lower than a predetermined value or when an increase in the current is detected, a first voltage supplied to the gate driver at the time, and determine the acquired first voltage as a voltage immediately before the gate driver becomes unable to be driven.

10. The non-transitory computer-readable storage medium according to claim 9, wherein the computer program further causes the control device to set a voltage greater than the acquired first voltage as a drive voltage for driving the gate driver.

* * * * *